United States Patent [19]

Chang

[11] 4,247,307

[45] Jan. 27, 1981

[54] HIGH INTENSITY IONIZATION-WET COLLECTION METHOD AND APPARATUS

[75] Inventor: Ching M. Chang, Williamsville, N.Y.

[73] Assignee: Union Carbide Corporation, New York, N.Y.

[21] Appl. No.: 77,849

[22] Filed: Sep. 21, 1979

[51] Int. Cl.[3] ..... B03C 3/09; B03C 3/78

[52] U.S. Cl. ..... 55/2; 55/119; 55/136; 55/152

[58] Field of Search ..... 55/2, 13, 118, 119, 55/136, 137, 138, 150, 152

[56] References Cited

U.S. PATENT DOCUMENTS

| | | | |
|---|---|---|---|
| 1,322,163 | 11/1919 | Conover | 55/150 |
| 1,357,201 | 10/1920 | Nesbit | 55/150 |
| 1,357,202 | 10/1920 | Nesbit | 55/152 |
| 1,425,637 | 8/1922 | Eschholz | 55/137 |
| 1,442,052 | 1/1923 | Dane | 55/138 |
| 1,667,954 | 5/1928 | Simington | 55/152 |
| 2,881,857 | 4/1959 | Cosby et al. | 55/150 |
| 3,668,835 | 6/1972 | Vicard | 55/138 |
| 3,979,193 | 9/1976 | Sikich | 55/152 |
| 4,093,430 | 6/1978 | Schwab et al. | 55/119 |
| 4,110,086 | 8/1978 | Schwab et al. | 55/13 |

FOREIGN PATENT DOCUMENTS

| | | | |
|---|---|---|---|
| 413800 | 7/1934 | United Kingdom | 55/136 |

*Primary Examiner*—David L. Lacey

*Attorney, Agent, or Firm*—Lawrence G. Kastriner

[57] ABSTRACT

In the pipe-type of high intensity ionization-wet collection method and apparatus for particle removal from a gas stream, corona current is distributed between adjacent ionization and collection zones.

15 Claims, 7 Drawing Figures

HIGH INTENSITY IONIZATION-WET COLLECTION METHOD AND APPARATUS

BACKGROUND OF THE INVENTION

This invention relates to a method of and apparatus for removal of fine particles from a gas stream by high intensity ionization and wet collection.

In order to achieve overall removal efficiencies greater than 95%, it is necessary to remove a major fraction of the fine particles (i.e., below about 3 micrometers diameter) from any particulate laden gas stream. Broadly speaking a wet ionization system is one in which the entrained particulates of a gas stream are electrically charged, forced from the gas stream onto a collecting electrode by an electric field, and removed from the collecting electrode by continuously flowing or intermittently spraying a thin film of wash water thereover. One wet ionization system is the pipe-type electrostatic precipitator, normally used for the collection of moist particulates and corrosive aerosols or in processes with relatively lower flow rates. Emissions with these latter characteristics are often found in the iron and steel, metallurgical chemical, pulp and paper, and mining industries. The emissions of a conventional blast furnace would be one typical example. The present invention pertains specifically to an electrostatic precipitator of the pipe-type.

The two main elements of a typical pipe-type precipitator are a tubular collection electrode, which is normally electrically grounded, and a thin wire discharge electrode, which is connected to a source of high voltage direct current. The wire typically has a diameter between 0.109 and 0.125 inch (0.277 to 0.318 cm), so that it emits a glow discharge or corona when a large potential is imposed between it and the outer tubular collecting electrode. The wire is positioned at the axis of the outer tubular collecting electrode and is typically maintained in this position by a weight which is suspended from the bottom of the wire.

In some pipe-type electrostatic precipitator applications, it is not possible to employ the thin wire design for the discharge electrode. For example, in acid-gas aerosol collection, the discharge electrode is normally formed from lead to ensure a long operating life in the corrosive environment. Because of lead's poor properties in tension, the discharge electrode must be formed with a relatively large overall diameter, for example about 0.375 inch (0.935 cm). However to ensure that a corona discharge is established, the discharge electrode is formed with a non-circular cross-section, for example square or star-shaped, having numerous sites of a small equivalent radius. Functionally, therefore, this design is equivalent to the standard thin wire design.

In operation of the pipe-type electrostatic precipitator, the particulate laden gas is fed into the bottom of the outer tubular collecting electrode which is vertically oriented. The gas passes upwardly through the tube and particulates charged by the corona discharge near the discharge electrode are collected by the outer tubular collecting electrode under the force of the electrostatic field. The clean gas therefore exists from the top end of the outer tubular collecting electrode. In most pipe-type electrostatic precipitators, the collected particulates are removed from the collecting electrode by flowing a thin film of water continuously down its inside wall.

An early design of a pipe-type electrostatic precipitator is described in Conover, U.S. Pat. No. 1,322,163. In the Conover design, the central discharge electrode comprises a metal rod with a series of spaced thin metal discs secured thereto. The surface area of the rod between each of the adjacent thin metal discs is encased within cylindrical separators. The separators are typically formed of an insulating material such as porcelain,, although metallic separators are also disclosed. The separators have a slightly smaller diameter than the thin metal discs. The separators maintain the thin metal discs in spaced position on the rod and prevent any corona leakage from the rod. The periphery of the discs is described as being smoothly contoured and may be semi-circular in shape.

Schwab et al. U.S. Pat. Nos. 4,093,430 and 4,110,806 describe a high intensity ionization system (hereafter referred to as "HII system") for particulate removal from gas streams wherein a disc-shaped discharge electrode is inserted in the throat of a Venturi diffuser. A high D.C. voltage is imposed between the discharge electrode or cathode and the Venturi diffuser, a portion of which acts as an anode. The high voltage between the two electrodes and the particular construction of the cathode disc produces a stable corona discharge of a very high intensity. Particles in the gas which pass through the electrode gap of the Venturi diffuser are charged to very high levels in proportion to their sizes. The entrained particulates are field charged by the strong applied field and by ion impaction in the region of corona discharge between the two electrodes. The high velocity of the gas stream through the Venturi throat prevents the accumulation of space charge within the corona field established at the electrode gap, and thereby improves the stability of the corona discharge between the electrodes.

The prior art has also adapted the Schwab et al. HII system to pipe-type electrostatic precipitators for wet collection. This device includes an inner elongated rod support electrode aligned along the axis of an outer tubular collecting electrode. At least one disc-shaped discharge electrode having a smoothly curved periphery is connected to the rod support electrode and is concentric with the outer tubular collecting electrode. A high potential (D.C.) is applied between the inner rod support electrode-discharge electrode assembly and the outer tubular collecting electrode. Because of the particular design, a thin radially and circumferentially uniform electrostatic field or corona discharge is established between the disc-shaped discharge electrode and the outer tubular collecting electrode, and a non-corona electric field is established between the rod support and the outer tubular collecting electrode. No corona is established between the rod support electrode and the outer tubular collecting electrode because of the relatively large diameter of the rod support electrode.

Particles entrained in the gas which is flowed through this prior art HII pipe-type wet precipitator system are charged as they pass through the corona discharge region established in the gap between the disc-shaped discharge electrode and the outer tubular collecting electrode. These so-charged particles are subsequently collected on the outer tubular collecting electrode under the influence of the non-corona electric field existing in the gap formed between the rod support electrode and the outer tubular collecting electrode. The particles are removed from the outer tubular collecting electrode by a thin film of water flowing along the inner wall of the outer tubular electrode.

According to the prior art HII pipe-type wet precipitator teachings, the disclosed construction is unique in that the electrostatic field between the disc-shaped discharge electrode and the outer tubular collecting electrode is relatively uniform and, therefore, has a high intensity without spark-over. Additionally, the prior practitioners emphasize that the electrostatic field is confined to a small axial direction (no corona in the gap between the rod support electrode and the outer tubular collecting electrode) so that the electrode assembly draws relatively little current when compared to the conventional pipe-type electrostatic precipitator design. Therefore, the power necessary to maintain the high intensity electrostatic field is said to be relatively low. Finally, the relatively large diameter of the rod support electrode with respect to the outer tubular collecting electrode reduces the gap therebetween. This was believed desirable as resulting in a higher strength electric collection field.

A limitation of all prior art pipe-type electrostatic precipitators is limited fine particle removal efficiency. In particular, the wire-type precipitators in current use provide fine particle removal efficiencies on the order of 80%. Although the prior art HII type of wet pipe precipitator represents an improvement by virtue of fine particle removal efficiencies on the order of 90%, a substantial fraction of the fine particles remain in the discharged gas.

An object of this invention is to provide an improved high intensity ionization pipe-type wet collection system.

A further object is to provide an improved HII pipe-type wet collection system for removal of fine particulates from a gas stream, with higher particle removal efficiencies than heretofore achieved.

Other objects and advantages of this invention will be apparent from the ensuing disclosure and appended claims.

SUMMARY

This invention relates to a method of and apparatus for removal of fine particles from a wet gas stream by high intensity ionization pipe-type wet collection.

I have discovered that fine particle removal in a high intensity ionization wet collection may be substantially increased by appropriately distributing the ionization current between localized ionization zones and particle collection zones, employing particular dimensional relationships between a rod electrode, a disc-shaped electrode(s) secured to the rod electrode, and a surrounding outer electrode tube.

In this invention, the corona current is efficiently distributed between adjacent ionization and collection zones rather than distributing it along an entire combined ionization and collection zone length as with conventional pipe-type electrostatic precipitators, or distributing it just to specific ionization sites, as with the prior art high intensity ionization wet pipe collection system. Instead, the bulk of the corona current is distributed to the high intensity ionization zones for charging the entrained particulates to a significantly higher saturation charge than can be obtained with prior pipe-type electrostatic precipitators. However, a fraction of the corona current is also distributed to the collection zones, which may be operated with a continuously wetted wall. The distribution of corona current in this manner is also advantageous when operating with intermittant water spray to remove particulates collected during operation with the outer tubular collecting electrode dry, as for example, in controlling fumes produced by the cyclic scarfing process. The average applied electric field in each collection zone is higher than employed in conventional pipe-type electrostatic precipitators, while the small amount of corona current in the collection zones is higher than that employed in the prior art HII system. This unique combination results in the more efficient collection of fine particulates.

In its broadest form, the apparatus of this invention includes a vertically positioned rod electrode of curvilinear cross-section having at least one disc-shaped discharged electrode secured thereto, an outer collecting electrode tube with a gas inlet end and a gas outlet opposite end longitudinally aligned with the rod electrode such that the outer tube inner wall and the peripheral edge of the disc-shaped discharge electrode are spaced to form a first transverse gap therebetween. There is also a second larger transverse gap between the rod electrode outer surface and the outer tube inner wall. More specifically, the rod electrode, the disc-shaped discharge electrode and the outer electrode tube are sized such that:

(a) at least a major portion of the rod electrode length has an equivalent diameter between 0.05 and 0.2 of the disc-shaped electrode maximum diameter;

(b) at least a major portion of the rod electrode length has an equivalent diameter between 0.02 and 0.1 of the outer tube inner wall equivalent diameter; and (c) said peripheral edge of the disc-shaped electrode is formed such that the ratio of the rod electrode equivalent diameter to the equivalent edge radius of the disc-shaped electrode is between 10 and 65.

The apparatus also includes direct current power supply means for imposing electric potential both: (i) between the disc-shaped electrode and the outer tube inner wall such that a relatively high intensity corona field may be established in the first gap, and (ii) between the rod electrode and the outer tube inner wall such that a relatively low intensity corona field may be established in the second gap.

The apparatus of this invention also includes means for introducing liquid at the upper end to the outer tube inner wall for downward flow and particle removal from the tube bottom end.

In the method aspect of this invention, a particulate-laden feed gas is flowed through an outer electrode tube in contact with a vertically positioned rod electrode of curvilinear cross-section having a multiplicity of longitudinally spaced disc-shaped discharge electrodes secured thereto with first transverse gaps between the peripheral edge of the disc-shaped electrodes and the outer tube inner wall and larger second transverse gaps between the rod electrode outer surface and the outer tube inner wall. The gas passes through a series of particulate high intensity corona ionization zones in the first gaps separated by particulate collection zones in the second gaps.

The method improvement comprises establishing direct current electric potentials across the second gaps in each of said particulate collection zones such that the electrostatic field strengths in the particulate collection zones are below the electrostatic field strengths in said ionization zones, but sufficient for corona discharge current across the second gaps. The electric field strengths in the particulate collection zones decrease in the gas flow path direction, but the corona discharge current in the same particulate collection zones increases in the same gas flow path direction.

In a preferred embodiment of the instant method, the electrostatic field strengths in the ionization zones increase in the gas flow path direction from the first ionization zone to the last ionization zone.

As used herein, particular terms and expressions shall have the following described meanings:

"Rod support electrod" or "rod electrode of curvilinear cross-section" means any generally cylindrically shaped elongated member having a smoothly contoured periphery with no highly convex sites facing the inner wall of the outer tubular collecting electrode. By way of example, this includes a multi-filament wound cable, and a member having a multiplicity of flat sides and curved intersections between adjacent sides.

"Equivalent diameter" of either the rod electrode or the outer collecting electrode tube refers to the periphery of the rod electrode and the inner wall of the outer collecting electrode tube. In each instance, it is determined by the formula, equivalent diameter $=(4A/\pi)^{\frac{1}{2}}$ where A is the cross-sectional area.

"Disc-shaped" means any closed shape having a periphery such as a circle, hexagon, or an elipse in "general conformity" with the cross-section of the outer tubular collecting electrode. As used herein "general conformity" includes a disc-shaped electrode having a circular periphery in an outer tubular collecting electrode having a regular polygonal cross-section. On the other hand, "general conformity" does not include a disc-shaped electrode having a rectangular periphery in an outer tubular collecting electrode having a circular cross-section.

"Periphery" refers to the outer extremity of the disc-shaped discharge electrode, and includes any sharp points as well as a smoothly contoured outer extremity. This definition is also intended to include a design in which the disc-shaped discharge electrode is formed by securing a plurality of discrete elments such as pins or projections to the rod support electrode. In this embodiment, the closed figure formed by circumscribing the outer limit or reach of the discrete elements must be "disc-shaped."

"Outer collecting electrode tube" means any elongated tubular member having a periphery with no highly convex sites facing the rod support electrode.

"Maximum diameter" refers to the largest straight line segment that subtends the disc-shaped discharge electrode.

"Equivalent edge radius" refers to the smallest radius of the circle that most nearly approximates the "peripheral edge" of the disc-shaped discharge electrode.

"Peripheral edge" refers to the outer contour of either the plan view or the end view of the disc-shaped discharge electrode.

"Ionization zone" refers to that wedge-shaped zone in the vicinity of the transverse gap between the disc-shaped discharge electrode peripheral edge and the outer tubular collecting electrode which is influenced by the axially expanding high intensity corona discharge.

"Collection zone" refers to the zone in the vicinity of the second transverse gap between the rod support electrode and the outer tubular collecting electrode, and in the longitudinal direction between the disc-shaped discharge electrode (if only one is employed) and the gas inlet and discharge ends, or between any two adjacent disc-shaped discharge electrodes, which zone is influenced by the radial corona discharge from the rod.

DESCRIPTION OF PREFERRED EMBODIMENTS

Figure 1:
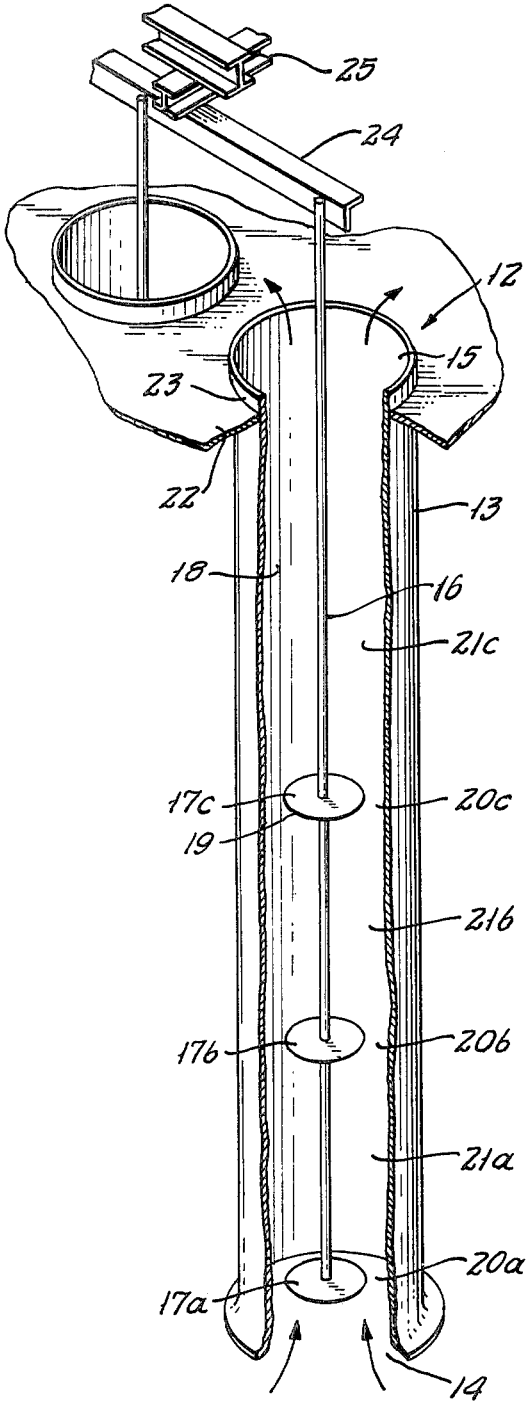
FIG. 1 is an isometric view looking downwardly with parts cut away, of a single rod-disc shaped electrode-outer tube precipitator assembly constructed according to this invention.

Referring now to the drawings, FIG. 1 shows an individual precipitator assembly 12 which includes vertically oriented outer tubular collecting electrode tube 13 with a feed gas inlet bottom end 14 and particulate-depleted gas outlet upper end 15. Rod electrode 16 of curvalinear cross section is vertically positioned and has secured thereto to disc-shaped discharge electrodes 17*a*, 17*b* and 17*c* longitudinally spaced from each other. The individual precipitation assembly 12 is sized such that the outer tube inner wall 18 is spaced from the peripheral edge 19 of each disc 17*a*–17*c* to form a first transverse gap. The particulates in the gas entering bottom end 14 are charged as they pass through an axially expanding, radially and circumferentially uniform corona discharge in the high intensity ionization zones emanating in wedge-shaped fashion from the disc peripheral edge into first gaps 20*a*, 20*b* and 20*c* between such edge and the outer tube inner wall 18. The charge particulates are then forced to the outer electrode tube inner wall 18 by the applied field in collection zones 21*a*, 21*b* and 21*c* between the rod electrode 16 and outer tuber inner wall 18. These collection zones are vertically spaced from each other by intermittantly positioned disc-shaped electrodes 20*b* and 20*c*. As will be explained hereafter in more detail, the particulate charging method is also continued in collection zones 21*a* and 21*b*, although at a substantially lower level than in ionization zones 20*a*, 20*b* and 20*c*, so that the overall particle charge density remains high.

The particulates deposited on the outer tube inner wall 18 are collected by a thin film of liquid (preferably water) which flows downwardly from the upper end 15 to the bottom end 14. This flow is preferably continuous but may be intermittent as for example by a water spray between non-continuous ionization periods. The water may be introduced by a pump p and flows over tube sheet 22 to weir 23 formed by projecting the outer tube upper end 15 above the tube sheet. The particulates collected by the downwardly flowing thin water film are discharged from the tube bottom end 14 into a collection sump and removed by a pump (not shown). The upper end of rod electrode 16 extends outside the outer tube 13 and is connected to a high voltage bus-bar 24 supported by superstructure 25.

Because of the need to distribute the corona or ionization current between the ionization and collection zones, the geometric relationships in precipitator assembly 12 between the rod support electrode and both the outer tubular collecting electrode 13 and the disc-shaped discharge electrode(s) 17*a*, 17*b* and 17*c* differs from the prior art HII pipe-type wet precipator over at least a major longitudinal portion thereof. The equivalent diameter of the rod support electrode is between 0.02 and 0.1 and preferably about 0.03 and 0.04 of the equivalent inside diameter of the outer tubular collecting electrode ($D_r/D_T$), and between about 0.05 and 0.2 and preferably about 0.07 to 0.12 of the maximum diameter of the disc-shaped discharge electrode ($D_r/D_D$). Relatively smaller diameter rod support electrodes with diameters below those defined by these ranges tend to produce excessive corona, thereby starving the ionization zones. Relatively larger diameter rod support electrodes do not produce enough corona to provide the desired increase in fine particle removal.

As previously stated, the peripheral edges of the disc-shaped electrode(s) 17*a*, 17*b* and 17*c* are formed such that the ratio (Dr/r) of the rod electrode equivalent diameter to the equivalent edge radius of the disc-shaped electrode is between 10 and 65. At ratios above about 65 there is insufficient corona discharge from the rod electrode to maximize the removal of fine particles. At ratios below about 10 the corona discharge from the rod electrode becomes too intense. Additionally, at ratios below 10 the intensity of the corona discharge in the ionization zones is severely decreased which causes a significant reduction in particle charging. Once again, the overall removal of fine particles suffers. A preferred balance between these opposing considerations is a Dr/r ratio between 20 and 40, as for example 25.

Although gas and liquid flow countercurrently in the previously described embodiment, concurrent flow may also be employed. For the latter, feed gas is introduced at the tube upper end 15 and the particulate-depleted gas discharged from the tube bottom end 14.

The high intensity ionization zone(s) is typically operated at an applied average intensity greater than about 6 Kv per centimeter at standard atmospheric conditions, while the applied field in the collection zone(s) is between about 3 Kv and 8 Kv per centimeter at standard atmospheric conditions.

Figure 2:
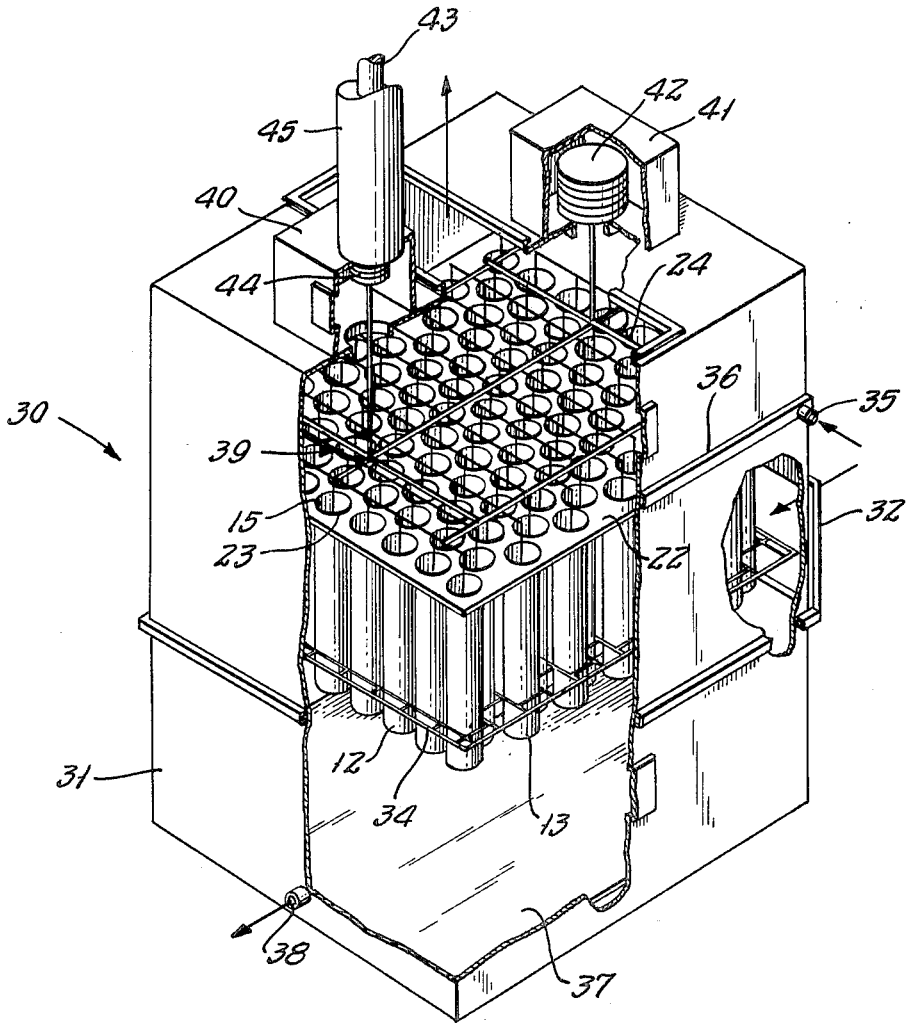
FIG. 2 is an isometric view looking downwardly with parts cut away, of a system for particulate removal from a gas stream, employing a multiplicity of the single rod-disc shaped electrode-outer tube precipitation assemblies illustrated in FIG. 1.

FIG. 2 illustrates precipitation system 30 including a multiplicity of interconnected individual rod-disc-outer tube assemblies 12 constructed according to this invention. The overall assembly is enclosed within casing 31, and the particulate-laden feed gas is introduced through inlet port 32 where it disperses and is evenly distributed by an array of individual rod-disc-outer tube assemblies 12. The gas then flows into the gas inlet end 14 of each vertically oriented outer tube 13. The individual assemblies 12 are positioned in a regular array by means of frame 34.

The previously mentioned water is introduced through inlet conduit 35 and water header 36 which may extend across one entire side wall of casing 31. The water disperses and is evenly distributed over the tube sheet 22 surrounding each of the outer tubes' upper end 15. The water then flows over weir 23 (illustrated in FIG. 1) into the gas outlet end 15 of each assembly 12 to sweep out the particulates from inner walls 18, and is discharged from lower ends 14 into collection sump 37 at the bottom of system 30. The particulate water mixture is removed from the sump through outlet conduit 38 by a pump (not shown).

The upper end of rod electrode 16 extends out of the outer tubular collecting electrode 13 where it is connected to a high voltage bus-bar 24. As shown, an entire row of rod electrodes 16 are connected to a single bus-bar 24. All of the rows are then connected by a bus-bar superstructure 39, shown in heavy black lines. The entire bus-bar structure is supported above the precipitator tube array by connections to the insulator compartments 40 and 41. Insulator 42 is illustrated in compartment 41, while the insulator for compartment 40 is not shown. The entire bus-bar structure 39 is connected to an external high voltage power supply or transformer-rectifier set (not shown) by a high voltage conductor 43. The conductor 43 passes through insulator compartment 40, feed-through insulator 44 and high voltage enclosure 45.

It is well-known that the ease of establishing corona and accordingly the quantity of corona current discharged for any given electrode is strongly influenced by the shape of the electrode. Sites on an electrode having very small radius of curvature or resembling sharp points are very prone to corona discharge. The conventional pipe-type electrostatic precipitator utilizes this phenomenon to establish a corona discharge along its entire length by employing a fine diameter wire as a discharge electrode. In contrast, smoothly contoured electrodes having a large radius of curvature do not normally exhibit a corona discharge, even under high voltage conditions. For this reason, disc-shaped discharge electrodes useful in the present invention are provided with a peripheral edge having a very small radius of curvature, typically in the range of 0.005 to 0.04 inch (0.013 cm to 0.1 cm), for example 0.016 inch (0.041 cm). In this way, a high intensity corona discharge is established throughout the normal operating voltage range (25–125 kv) of the device.

Unlike the prior art pipe-type of high intensity ionizer, according to this invention at least a major longitudinal portion of the rod electrode is operated in the corona regime, so that this electrode must also be provided with a smaller radius of curvature. Nonetheless, the radius must not be so small that excessive corona current is emitted by the rod electrode. The equivalent diameter of the rod electrode is preferably in the range of 0.25 to 1.0 inch (0.6 to 2.5 cm).

Although a major portion of the rod support electrode must satisfy the above-defined geometrical requirements, the invention does contemplate that minor portions of the rod electrode may be designed according to prior art teachings. Because of corona quenching considerations, it may be advantageous to decrease the equivalent diameter of the rod support electrode from the gas inlet end to the gas outlet end. In this apparatus embodiment of the invention the major portion of the rod electrode length comprises at least two longitudinal sections having different equivalent diameters. A first longitudinal section of largest equivalent diameter is positioned nearest the gas inlet and a second longitudinal section of smallest equivalent diameter is positioned nearest to the gas outlet end. With a constant value for the outer tube diameter, this longitudinally increases the second transverse gap width between the rod electrode outer surface and the outer tube inner wall.

This feature is preferably although not essentially employed with the prior art feature of increasing the effective diameter of the disc-shaped electrodes from the gas inlet end to the gas outlet end. In this way, the disc periphery-outer tube inner wall first transverse gap width is longitudinally decreased and the most intense corona for particle charging is generated where it is most needed—near the gas outlet end where the smallest particles predominate.

According to this embodiment, near the gas inlet end where most of the larger particles are collected, one would use a relatively small diameter disc-shaped discharge electrode on a relatively large diameter rod support electrode which does not generate any corona current. Such a relationship prevents excessive corona quenching and produces a focused, yet weak, corona discharge field sufficient to control large diameter particles. Near the gas outlet end where the smallest particles must be collected, one would employ a relatively large diameter disc-shaped discharge electrode on a relatively small diameter rod support electrode such as a fine wire or a star wire as in a conventional pipe-type precipitator. Such a design produces a diffuse, yet strong corona discharge field and maximizes the collection of the smallest particles.

Figure 3:
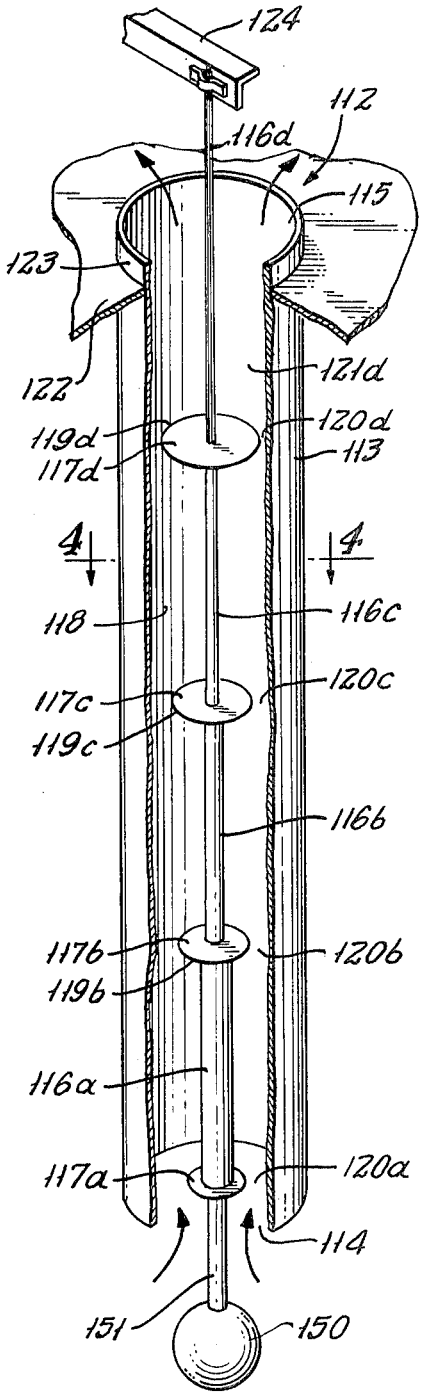
FIG. 3 is an isometric view looking downwardly with parts cut way, of another single rod-disc shaped electrode-outer tube precipitator assembly embodiment of this invention which employs a sectionalized rod electrode with varying diameters and disc-shaped electrodes of varying diameters.

FIG. 3 illustrates a single rod-disc-outer tube precipitator of this invention constructed in accordance with the foregoing longitudinally varying size relationship for the rod electrode and the disc-shaped electrodes. Where appropriate, the various elements have been identified by adding 100 to numbers used in the FIG. 1 embodiment for corresponding elements. Referring now to FIG. 3, the precipitator assembly 112 includes an outer tubular collecting electrode 113 surrounding a plurality of disc-shaped discharge electrodes 117*a*–117*d*. The rod support electrode is formed from a plurality of cylindrical sleeves 116*a*–116*c* of progressively decreasing diameter from the gas inlet end 114 toward the gas outlet end 115, and a longitudinal portion of star wire 116*d* at the discharge end. The outer tubular collecting electrode 113 is supported from the tube sheet 112 which completely surrounds tube 113 upper end. The rod support electrode-disc-shaped discharge electrode assembly is supported from bus-bar 124.

The combination of the cylindrical sleeves and the disc-shaped discharge electrodes forms a segmented assembly suitable for retrofit applications. Prior to retrofitting the FIG. 3 system to embody the present invention, the assembly may have typically consisted of a conventional pipe-type electrostatic precipitator employing a star-shaped discharge electrode 116*d* which was attached to bus-bar 124 and aligned along the longitudinal axis of the outer tubular collecting electrode 113. The star-shaped discharge electrode was maintained in this position by means of weight 150 attached at the lowermost end of the star-shaped discharge electrode 116*d*. To upgrade this conventional system to the present invention, the star-shaped discharge electrode 116*d* is first disconnected from bus-bar 124. A first cylindrical sleeve 151 is then slid over the star-shaped discharge electrode and rests on the weight 150. The length of this first cylindrical sleeve 151 is such that when the first and smallest effective diameter disc-shaped discharge electrode 117*a* is slid over the star-shaped discharge electrode diameter 116*d*, it rests on the upper end of this first cylindrical sleeve 151 at a position adjacent to the gas inlet end 114 of outer tubular collecting electrode 113. In this embodiment, the first disc-shaped discharge electrode 117*a* has a relatively small diameter so as to minimize the amount of corona quenching caused by the flow of particulate laden gas.

Next, the second cylindrical sleeve 116*b* is slid over the star-shaped discharge electrode 116*d* followed by the second disc-shaped discharge electrode 117*b* and the sequence is continued through largest diameter disc-shaped discharge electrode 117*d*. The second cylindrical sleeve 116*a* has a relatively large diameter so that it emits no corona.

By way of illustration, the spaced disc-shaped discharge electrodes 117*b* and 117*c*, and the cylindrical sleeve sections 116*b* and 116*c* satisfy the geometric relationships of this invention. As a result, appropriate amounts of corona current are distributed in progressively smaller gaps 120*b* and 120*c* forming ionization zones, and collection zone 121*b* therebetween. The disc-shaped electrode 117*d* nearest the gas outlet end 115 has the largest diameter of these electrodes so that the high intensity ionization corona discharge in gap 120*d* between its peripheral edge 119*d* and the tube inner wall 118 is the most intense. The uppermost portion 116*d* of the rod support electrode is formed solely by the unenclosed star-shaped wire. With this construction, the particle collection zone 121*d* at the gas outlet end 115 exhibits the highest corona field. The combination of largest diameter disc-shaped electrode 120*d* and smallest effective diameter star-wire section 116*d* allows the zone of maximum corona current to operate on the smallest particles, all while avoiding the adverse effects of corona quenching.

It should be understood that in the practice of this embodiment it is not essential for each disc-outer tube inner wall first gap to be different from the immediately preceding or subsequent first gap in the gas flow path. Similarly, each rod-outer tube inner wall second gap need not be different from the immediately preceding or subsequent second gap in the gas flow path. In particular, it may be advantageous to employ at least two cylindrical sleeves 116 of the same outer diameter or at least two disc-shaped electrodes having the same maximum diameter.

Figure 4:
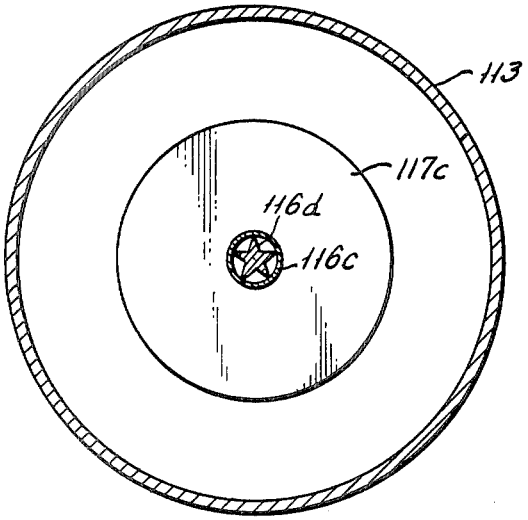
FIG. 4 is a cross-section view of the FIG. 3 precipitator taken along line 4—4.

The FIG. 4 cross-sectional view taken along line 4—4 of FIG. 3 more clearly illustrates the described assembly. In its broadest aspect, a major portion of the rod electrode length comprises at least two longitudinal sleeve sections concentrically and removably positioned around a small diameter wire electrode, with longitudinally adjacent sleeve sections transversely separated by a disc-shaped electrode. In FIG. 4, the star-shaped discharge electrode length below length 116*d* is surrounded by a multiplicity of vertically superimposed cylindrical sleeves 116*a*–116*c*. Between any two adjacent cylindrical sleeves, a disc-shaped discharge electrode 120*b* or 120*c* is transversely positioned. By this above-described procedure, a conventional pipe-type electrostatic precipitator of the thin wire discharge electrode type may be easily retrofitted to the present invention.

In the operation of the FIG. 3–4 device according to the method of this invention, a particulate-laden feed gas is introduced to inlet end 114 of the vertically oriented outer collecting electrode tube 113. The particulates in the gas entering inlet end 114 are electrically charged as they pass through the axially expanding, radially and circumferentially uniform corona discharge established in the ionization zones 120*b*, 120*c* and 120*d* between the disc-shaped discharge electrodes 121*a* through 121*d* and the inner wall 118 of tubular collecting electrode 113. The charged particulates are then forced to the outer tubular collecting electrode 113 by the applied field existing in the collection zones 121*b*, 121*c* and 121*d* between the segmented rod support electrode comprising sleeve lengths 116*a*, 116*b*, 116*c* and star-wire length 116*d*, and the outer tubular collecting electrode 113.

As noted previously, the particulate charging method also continues in the collection zones, although at a substantially lower level than in the ionization zones, so that the overall particulate charge density remains high. From the method standpoint, the particulate-laden gas flows sequentially upwardly through a series of alternating partculate ionization zones 120*b*, 120*c* and 120*d* and particulate collection zones 121*b*, 121*c* and 121*d*. A direct current electric potential is established in the transverse direction of each zone so as to form electrostatic fields in the nature of corona discharges. The electric field strength in each of the ionization zones is high intensity—higher than that existing in the particulate collection zones. Also, in the upward gas flow path the electric field strength in the high intensity ionization zones increases as the first gap widths diminish. Conversely, the electric field strength in the gas flow path decreases in the particle collection zones as the second gap widths increase. However, the corona current in the collection zones progressively increases as the second gap width increases.

The particulates deposited on the inner wall 118 of the outer tubular collecting electrode 113 are collected by a thin film of water which preferably continuously coats the inner wall. The water is introduced by a pump (not shown) and is evenly distributed over the tube sheet 122 which surrounds all of the precipitator assemblies 112. The water then flows over weir 123 into the gas outlet end 115 of each precipitator assembly 112. As shown, weir 123 is formed by projecting the upper end of the outer tubular collecting electrode 113 through the tube sheet 122. The particulates are collected by the thin water film flowed downwardly therewith into a collection sump (not shown) at the bottom of the precipitator assembly 112. The particulate laden water is then removed from the sump by means of a pump (not shown).

Although the rod has been specifically described in the form of a single member having a circular cross-section, other forms are suitable as long as they do not have sharp convex peripheral edges, i.e., non-curvalinear forms. The latter would be unsatisfactory as constituting potential sparking sites. Also, the rod electrode need not be in the form of a single solid number.

Figure 5:
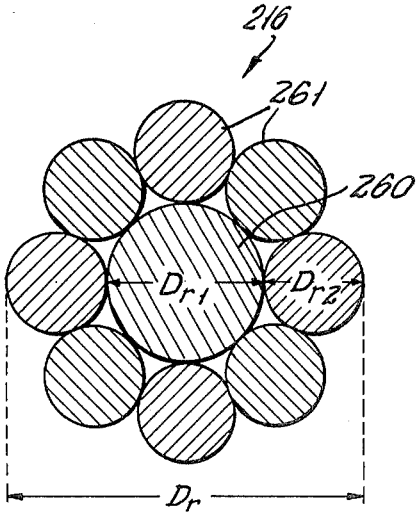
FIG. 5 is a cross-section end view of another rod electrode embodiment formed from multi-filament wound cable.

Referring now to FIG. 5, another suitable design for the rod support electrode of this invention is shown in cross-section. In this embodiment, the rod 216 comprises a multi-filament wound cable. As shown, the cable comprises a center filament or wire 260 having a diameter Dr surrounded by eight smaller filaments or wires 261, each having a diameter $Dr_2$. The eight outer wires 261 are wound in a spiral fashion around the inner wire 260. The entire assembly has an overall width Dr. However, for purposes of defining the rod electrode of this invention, the equivalent diameter of this assembly is somewhat less than Dr. For this purpose, the equivalent diameter of the FIG. 5 embodiment may be calculated by Equation (1):

$$D_{r\,eg} = \left(\sum_{i=1}^{n} D_{ri}^2\right)^{\frac{1}{2}} \tag{1}$$

where n = the number of filaments and $D_{ri}$ = the diameter of the $i^{th}$ filament In the specific case of FIG. 5, $D_{r\,eq} = (D_{r1}^2 + 8\,D_{r1}^2)^{\frac{1}{2}}$. For example, if $D_{r1} = 0.125$ and $D_{r2} = 0.088$ than $D_{r\,eq} = 0.18$. A cable having an equivalent $D_{r\,eq}$ satisfying this invention will function analogously to a cylindrical rod having the same diameter $D_{r\,eq}$.

Figure 6A:
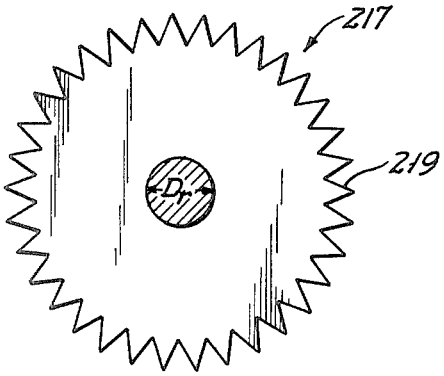
FIG. 6*a* is a cross-section end view of another disc-shaped electrode embodiment having a saw-toothed peripheral edge.
Figure 6B:
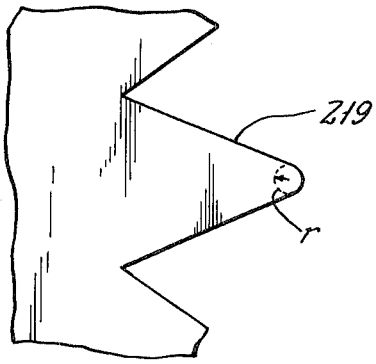
FIG. 6*b* is a detail of the FIG. 6*a* disc-shaped electrode peripheral edge showing its equivalent edge radius.

FIGS. 6*a* and 6*b* illustrate another possible configuration for the disc-shaped discharge electrode of the invention. In this instance, the electrode is provided with a saw-toothed peripheral edge 219. Unlike the curvalinear cross-section requirement of the rod support electrode, the disc-shaped electrode may have relatively sharp convex edges. Each point on the edge represents a site where a corona discharge will occur. Each point will also have an equivalent edge radius r (shown in the FIG. 6*b* enlargement) which together with the other components of the assembly must satisfy the various geometric constraints of the invention.

A series of tests were conducted which illustrate the superiority of the present invention with respect to prior art pipe-type electrostatic precipitator designs. The results of these tests are summarized in Tables A through C.

In the Table A comparison, the operating characteristics of a pipe-type electrostatic precipitator constructed according to this invention as generally illustrated in FIG. 1 (Item 2) is compared with the operating characteristics of a conventional pipe-type precipitator employing a 0.125 inch (0.318 cm) diameter thin wire discharge electrode (Item 1). In each instance, the outer collecting electrode tube is 120 inches (305 cm) long and has an inside diameter $D_T$ of 12 inches (30.5 cm). The precipitator of this invention includes a single disc-shaped discharge electrode of 5 inches (12.7 cm) maximum diameter $D_D$ which is positioned 12 inches (30.5 cm) from the inlet bottom end of the outer tubular collecting electrode. The disc is secured to a rod electrode of 0.375 inch (0.953 cm) equivalent diameter Dr. The equivalent edge radius of the disc-shaped electrode r is 0.0156 inch (0.0396 cm). Each assembly was operated under the maximum electrical conditions (voltage and current) without sparking. Air at 120° F. (49° C.) was passed through each precipitator at 700 acfm (19.8 $am^3$/min) and contained particulates having a mass mean diameter of 2 microns. These conditions were also used in the remaining tests.

The operating efficiencies of these two devices are best compared by the percent reduction in penetration provided by one device relative to the other. Percent reduction in penetration is defined by the following Equation (2):

$$P = \frac{(1 - \eta_1) - (1 - \eta_2)}{(1 - \eta_1)} \times 100\% \quad (2)$$

where p = percent reduction in penetration, $\eta_1$ = collection efficiency of the less efficient collection device, and $\eta_2$ = collection efficiency of the more efficient collection device.

This equation (2) parameter reflects the additional fraction of particulates which one collection device is able to remove beyond what a less efficient collection device was able to remove. At high collection efficiencies, the percent improvement can be primarily attributed to increased fine particle collection. As shown in Table A, the simplest embodiment of the present invention, i.e., employing only a single disc-shaped discharge electrode, provides a 48.1% reduction in penetration relative to the conventional pipe-type precipitator design.

As previously discussed under "Background of the Invention", the thin wire discharge electrode of the prior art design cannot be used under all operating conditions. In a corrosive environment such as the collection of an acid-gas aerosol, material constraints force the designer to employ larger diameter discharge electrodes. To maintain a high level of corona discharge along the length of the wire, the wire must be formed with a non-circular cross-section having numerous sharp edges to produce corona. A commonly used design is represented by a wire with a star-shaped cross-section.

In the light of the high intensity ionization pipe-type wet collection prior art, one potential method for upgrading the collection efficiency of the conventional pipe-type precipitator is to provide the wire discharge electrode with a plurality of spaced apart disc-shaped discharge electrodes. To examine the effectiveness of this HII prior art approach, a precipitator having a star-shaped discharge electrode of 0.375 inch (0.953 cm) diameter and fitted with five disc-shaped discharge electrodes was tested. In each instance the outer collecting electrode tube is 120 inches (305 cm) long and has an inside diameter $D_T$ of 12 inches (30.5 cm). Table B presents the results of this test work (Item 1) and permits comparison with an electrostatic precipitator designed according to the present invention also employing five disc-shaped discharge electrodes (Item 2). For Item 2 the rod electrode has an equivalent diameter Dr of 0.375 inches (0.953 cm). The equivalent edge radius of the disc-shaped electrode r is 0.0156 inch (0.0396 cm). The lowermost discharge electrode is positioned 12 inches (30.5 cm) from the inlet end of the outer tubular collecting electrode in both assemblies. The remaining four discharge electrodes are then equally spaced 18 inches (45.7 cm) from one another.

The two assemblies were each operated under their respective maximum electrical conditions without sparking (voltage and current) and similar inlet grain loadings. As shown, the Item 2 system according to this invention provides a 25.9% reduction in penetration relative to the modified conventional precipitator design employing a star-shaped discharge electrode.

Referring to Table C, a comparison of the operating characteristics of a pipe-type electrostatic precipitator designed according to the teachings of the high voltage ionizer pipe-type wet collector prior art (Item 1) with an equivalent design of the present invention (Item 2) is presented. In each instance the outer collecting electrode tube is 120 inches (305 cm) long and has an inside diameter $D_T$ of 12 inches (30.5 cm). The equivalent diameters Dr of the rod electrodes are 2 inches (5.1 cm) (Item 1) and 0.375 inch (0.953 cm) (Item 2). The equivalent edge radius r for all disc-shaped electrodes is 0.0156 inch (0.0396 cm).

In both systems, the lowermost discharge electrode is positioned 12 inches (30.5) from the inlet end of the outer tubular collecting electrode. The remaining discharge electrodes are then equally spaced along the rod support electrode 8 inches (20.3 cm) from one another. The two assemblies were operated under maximum electrical conditions without sparking (voltage and current) and similar inlet grain loadings. As illustrated, the present invention provides a 28% reduction in penetration relative to the prior art high intensity ionizer-pipe collector.

Although certain embodiments of the invention have been described in detail, it will be appreciated that other embodiments are contemplated, along with modifications of the disclosed features, as being within the scope of the invention.

TABLE A

| Item No. | Electrode Configuration $D_r/D_T$ | $D_r/D_D$ | $D_r/_r$ | $D_D/D_T$ | Average Operating Voltage ($K_v$) | Average Operating Current (mA) | Average Grain Loading (Grains/ACF) | Average Collection Efficiency (%) | Reduction In Penetration (%) |
|---|---|---|---|---|---|---|---|---|---|
| 1. | 0.01 | — | 24.0 | | 36.2 | 1.67 | 0.50[1] | 84.10 | — |
| 2. | 0.031 | 0.075 | | 0.417 | 48.5 | 1.58 | 0.42[2] | 89.50 | 48.1 |

[1]1.16 Grams/Acm
[2]0.97 Grams/Acm

TABLE B

| Item No. | Electrode Configuration $D_r/D_T$ | $D_r/D_D$ | $D_r/_r$ | $D_D/D_T$ | Average Operating Voltage ($K_v$) | Average Operating Current (mA) | Average Grain Loading (Grains/ACF) | Average Collection Efficiency (%) | Reduction In Penetration (%) |
|---|---|---|---|---|---|---|---|---|---|
| 1. | 0.031 | 0.107[a] | | 0.292[a] | 59.0 | 4.3 | 0.36[1] | 97.72 | — |
| | | 0.094[b] | | 0.333[b] | | | | | |
| | | 0.075[c] | | 0.075[c] | | | | | |
| 2. | 0.031 | 0.107[a] | | 0.292[a] | 57.3 | 3.5 | 0.56[2] | 98.31 | 25.9 |
| | | 0.094[b] | | 0.333[b] | | | | | |

TABLE B-continued

| Item No. | Electrode Configuration $D_r/D_T$ | $D_r/D_D$ | $D_r/_r$ | $D_D/D_T$ | Average Operating Voltage ($K_v$) | Average Operating Current (mA) | Average Grain Loading (Grains/ACF) | Average Collection Efficiency (%) | Reduction In Penetration (%) |
|---|---|---|---|---|---|---|---|---|---|
| | | 0.075[c] | | 0.075[c] | | | | | |

[1]0.84 Grams/Acm
[2]1.30 Grams/Acm
[a]One disc-shaped discharge electrode
[b]Three disc-shaped discharge electrodes
[c]One disc-shaped discharge electrode

TABLE C

| Item No. | Electrode Configuration $D_r/D_T$ | $D_r/D_D$ | $D_r/_r$ | $D_D/D_T$ | Average Operating Voltage ($K_v$) | Average Operating Current (mA) | Average Grain Loading (Grains/ACF) | Average Collection Efficiency (%) | Reduction In Penetration (%) |
|---|---|---|---|---|---|---|---|---|---|
| 1. | 0.167 | 0.571[a] | | 0.292[a] | 61.8 | 4.8 | 0.64[1] | 98.11 | — |
| | | 0.500[b] | | 0.333[b] | | | | | |
| | | 0.400[c] | | 0.417[c] | | | | | |
| 2. | 0.031 | 0.107[a] | | 0.292[a] | 57.0 | 4.2 | 0.62[2] | 98.64 | 28.0 |
| | | 0.094[b] | | 0.333[b] | | | | | |
| | | 0.075[c] | | 0.417[c] | | | | | |

[1]1.48 Grams/Acm
[2]1.44 Grams/Acm
[a]Three disc-shaped discharge electrodes
[b]Five disc-shaped discharge electrodes
[c]Five disc-shaped discharge electrodes

What is claimed is:

1. Apparatus for removing particles from a feed gas stream comprising: a vetically positioned rod electrode of curvilinear cross-section having at least one disc-shaped discharge electrode secured thereto, an outer collecting electrode tube with a gas inlet end and a gas outlet opposite end longitudinally aligned with the rod electrode such that the outer tube inner wall and the peripheral edge of the at least one disc-shaped discharge electrode are spaced to form a first transverse gap therebetween and a second larger transverse gap between the rod electrode outer surface and said outer tube inner wall, with said rod electrode, said at least one disc-shaped discharge electrode and said outer electrode tube being sized such that:

(a) at least a major portion of the rod electrode length has an equivalent diameter between 0.05 and 0.2 of the at least one disc-shaped electrode maximum diameter;

(b) at least a major portion of the rod electrode length has an equivalent diameter between 0.02 and 0.1 of the outer tube inner wall equivalent diameter;

(c) said peripheral edge of the at least one disc-shaped electrode is formed such that the ratio of the rod electrode equivalent diameter to the equivalent edge radius of said at least one disc-shaped electrode is between 10 and 65; direct current power supply means for imposing electric potential both: (i) between said at least one disc-shaped electrode and said outer tube inner wall such that a relatively high intensity corona field may be established in said first gap, and (ii) between said rod electrode and said outer tube inner wall such that a relatively low intensity corona field may be established in said second gap; and means for introducing liquid at the upper end to said outer tube inner wall for downward flow and particle removal from the bottom end.

2. Apparatus according to claim 1 in which said major portion of the rod electrode length has an equivalent diameter between 0.03 and 0.04 of the outer tube inner wall equivalent diameter.

3. Apparatus according to claim 1 in which said major portion of the rod electrode length has an equivalent diameter between 0.07 and 0.12 of the disc-shaped electrode maximum diameter.

4. Apparatus according to claim 1 in which said ratio of the rod electrode equivalent diameter to the equivalent edge radius of said at least one disc-shaped electrode is between 20 and 40.

5. Apparatus according to claim 1 in which said equivalent edge radius of said at least one disc-shaped electrode is between 0.005 to 0.04 inch.

6. Apparatus according to claim 1 in which said equivalent diameter of said rod electrode is between 0.25 and 1.0 inch.

7. Apparatus according to claim 1 in which said major portion of the rod electrode length comprises a small diameter wire electrode with at least two longitudinal sleeve sections concentrically and removably positioned around said small diameter wire electrode, with longitudinally adjacent sections transversely separated by said at least one disc-shaped electrode.

8. Apparatus according to claim 1 in which said major portion of the rod electrode length comprises at least two longitudinal sections having different equivalent diameters and a first longitudinal section of largest equivalent diameter positioned nearest to said gas inlet end and a second longitudinal section of smallest equivalent diameter positioned nearest to said gas outlet end.

9. Apparatus according to claim 8 in which said major portion of the rod electrode length is a small diameter wire electrode and said longitudinal sections comprise sleeves concentrically and removably positioned around said small diameter wire electrode, with longitudinally adjacent sections transversely separated by said at least one disc-shaped electrode.

10. Apparatus according to claim 8 wherein said at least one disc-shaped discharge electrode comprises at least two of said disc-shaped discharge electrodes having different maximum diameters, a first disc-shaped discharge electrode of smallest maximum diameter being secured to said rod electrode nearest to said gas inlet end, and a second disc-shaped discharge electrode of largest maximum diameter secured to said rod electrode nearest to said gas outlet end.

11. Apparatus according to claim 1 in which said major portion of the rod electrode length comprises at least two longitudinal sections having different equivalent diameters with a first longitudinal section of largest equivalent diameter positioned nearest to said gas inlet end and a second longitudinal section of smallest equivalent diameter positioned nearest to said gas outlet end; and wherein said at least one disc-shaped discharge electrode comprises at least two of said disc-shaped discharge electrodes having different maximum diameters with a first disc-shaped discharge electrode of smallest maximum diameter being secured to said rod electrode nearest to said gas inlet end and a second disc-shaped discharge electrode of largest maximum diameter secured to said rod electrode nearest to said gas outlet end.

12. Apparatus according to claim 11 in which said major portion of the rod electrode length is a small diameter wire electrode and said longitudinal sections comprise sleeves concentrically and removably positioned around said small diameter electrode, with longitudinally adjacent sections transversely separated by one of said disc-shaped electrodes.

13. Apparatus according to claim 1 in which said rod electrode is a multi-filament wound cable.

14. In a high intensity ionization method for removing particles from a feed gas stream, by flow through an outer electrode tube, in contact with a vertically positioned rod electrode of curvilinear cross-section having a multiplicity of longitudinally spaced disc-shaped discharge electrodes secured thereto with first transverse gaps between the peripheral edge of said disc-shaped electrodes and the outer tube inner wall and larger second transverse gaps between the rod electrode outer surface and said outer tube inner wall, through a series of particulate high intensity corona ionization zones in the first gaps separated by particulate collection zones in the second gaps; the improvement comprising establishing direct current electric potentials across said second gaps in each of said particulate collection zones such that electrostatic field strengths in said particulate collection zones are below the electrostatic field strengths in said ionization zones but sufficient for corona discharge current across said second gaps with the electric field strengths in said particulate collection zones decreasing in the gas flow path direction, but with the corona discharge current in said particulate collection zones increasing in the gas flow path direction.

15. A method according to claim 14 in which the electrostatic field strength in said ionization zones increases in the gas flow path direction.

* * * * *

UNITED STATES PATENT AND TRADEMARK OFFICE

CERTIFICATE OF CORRECTION

PATENT NO. : 4,247,307

DATED : January 27, 1981

INVENTOR(S) : Ching M. Chang

It is certified that error appears in the above-identified patent and that said Letters Patent are hereby corrected as shown below:

In col. 1, line 63, "exists" should read -- exits --.

The phrase "presents the results of this test work (Item 1) and per-" in col. 13, line 56 is out of place, and belongs at col. 13, line 47.

Signed and Sealed this

*Seventh* Day of *July 1981*

[SEAL]

*Attest:*

RENE D. TEGTMEYER

*Attesting Officer*

*Acting Commissioner of Patents and Trademarks*